US008051790B2

(12) United States Patent
Colangelo

(10) Patent No.: US 8,051,790 B2
(45) Date of Patent: Nov. 8, 2011

(54) LCAC LANDER, LAUNCHER AND LIFTER

(76) Inventor: Vladislav Francis Colangelo, Metairie, LA (US)

( * ) Notice: Subject to any disclaimer, the term of this patent is extended or adjusted under 35 U.S.C. 154(b) by 547 days.

(21) Appl. No.: 12/215,970

(22) Filed: Jul. 1, 2008

(65) Prior Publication Data

US 2010/0000459 A1 Jan. 7, 2010

(51) Int. Cl.

| | |
|---|---|
| ***B63B 35/00*** | (2006.01) |
| ***B63B 35/40*** | (2006.01) |
| ***B63B 27/00*** | (2006.01) |
| ***B63B 27/14*** | (2006.01) |
| ***B63C 1/02*** | (2006.01) |

(52) U.S. Cl. ..... 114/258; 114/259

(58) Field of Classification Search ..... 114/60, 114/70, 72, 258–260, 362; 414/137.1, 137.7, 414/137.8

See application file for complete search history.

(56) References Cited

U.S. PATENT DOCUMENTS

| | | | | |
|---|---|---|---|---|
| 3,437,066 | A * | 4/1969 | Schwendtner | 114/260 |
| 4,195,962 | A * | 4/1980 | Laskowski et al. | 414/659 |
| 4,350,112 | A * | 9/1982 | Ayotte | 114/260 |
| 6,487,981 | B1 * | 12/2002 | Burg | 114/67 A |
| 6,792,886 | B1 * | 9/2004 | Maloney et al. | 114/60 |
| 7,296,528 | B1 * | 11/2007 | Doyle et al. | 114/258 |
| 7,654,211 | B2 * | 2/2010 | Maloney et al. | 114/67 R |
| 2002/0164231 | A1 * | 11/2002 | Lucas et al. | 414/137.4 |

* cited by examiner

*Primary Examiner* — Ajay Vasudeva
(74) *Attorney, Agent, or Firm* — Juan J. Lizarraga

(57) ABSTRACT

Presented is an advance naval ship's stern appendage called an LCAC (Landing Craft Air Cushion) Lander, Launcher and Lifter ($L^4$ system) to provide for landing and launching of amphibious hovercraft and increase the delivery capacity of amphibious hovercraft by naval vessels. The stern appendage which may be retrofitted on existing vessels or fully designed into new hull forms of new ships. Included in the stern appendage are longitudinally extending cantilever wing-walls, at least one hoistable platform with a backstop fold up gate, a med-moor ramp, drainage ducts, a resistance reduction leading edge, locking pins and a transfer conveyor system for amphibious hovercraft to gain access to and from the ship's decks above the waterline, and a hoisting system for raising and lowering the hoistable platform between said cantilever wingwalls.

12 Claims, 12 Drawing Sheets

LCAC LANDER, LAUNCHER AND LIFTER

FIELD OF THE INVENTION

The present invention relates to the field of naval vessels that deploy and recover amphibious hovercraft called Landing Craft Air Cushion ("LCAC") and similar amphibious lighters.

BACKGROUND OF THE INVENTION

There are several discernible naval limitations in deployment and retrieval of LCAC's. No active naval vessel has an operation/capability to recover from sea or pier an LCAC (or similar) and stow the LCAC onto its upper-most deck. No active naval vessel has the capability/operations-to deploy into the sea or onto pier an LCAC from its upper-most deck. There are no naval vessels capable of ferrying LCACs to a theater of operations without the penalty of an inordinate overhead of thousands of on-board naval personnel. There are no naval vessels that are capable with normal operation of deploying and recovering LCACs of greater width than their interior floodable well deck. Since current LCAC operations are oversortied due their fewness, prone to aborted missions due to environmental hardship, time-tabled to maintenance and repair, their potentials are underutilized and undercapitalized.

The inventive LCAC launcher, lander and lifter system (hereafter called the $L^4$ system) is a dramatic innovation in modem amphibious warfare technology. It is as a compelling technology for naval ships as is the retractable landing gear for modem aircraft. The $L^4$ system overcomes the above limitations using a specialized elevator system operable at sea.

SUMMARY OF THE INVENTION

The $L^4$ system is a ship's stem appendage whose primary objective is to provide a safe haven landing and launching facility to amphibious craft such as the LCAC, SES, EFV, AAAV (see glossary) and their subsequent mechanized lifting to gain access to/from the ship's decks above the waterline. Its major equipment comprises at least one hoistable platform with backstop fold-up gate and thereon hinged medmoor stem ramp, two or more cantilever wing walls (hereinafter "cantilevers") extending longitudinally from the ship's stem, exposed-deck taxiway foldable bulwarks, an auxiliary transfer/conveyer system, operating machinery and electronics, erectable cross bridges for trolley/gantry cranes, and a traffic/platform controller station housed in at least one of the cantilevers. The $L^4$ system is retrofitable to a variety of naval vessels having transom stems such as the LPD, LHA, etc. or it can be fully designed into new hull forms of new ships.

The $L^4$ system deploys, recovers and stows unloaded or loaded, static or powered LCACs (or similar) at sea or land from/to the ship's upper-most deck or any level in between. The application of the $L^4$ system to candidate naval vessels in preliminary ship design is shown by illustration and analysis using the LPD, T-AKR, and LSD as examples.

The $L^4$ system also enables the carriage of outsized wide-bodied LCACs (up to 60' or more as constrained by vessel dimensions and type) on the upper-most deck. This transport feature allows for pre-acceptance delivery of experimental wide-bodied LCACs into war theaters for early combat evaluation. The $L^4$ system can provide accommodations for potentially 800 additional marines within the cantilevers.

The platform component of the $L^4$ system offers unique features including but not limited to providing stowage to an LCAC (or similar); a terminal for LCAC cargo discharge/loading; a docking ramp to other ramps; and a direct sea and shoreside interface. The platform can assume any construction dimensions, provides for water shedding and cushions air pressure maintenance and has conveyer provision for static or disabled LCAC blockage prevention. The platform could also offer resistance reduction leading edge shape. In addition, the platform is designed with interlocking cantilever pins for safety considerations. The platform is also a lifting device for the assembly and disassembly of structural members in the construction of cross bridges for trolley/gantry cranes.

As a carrier the platform is designed to provide a parking spot to an LCAC (or similar) when the platform is stowed and locked at the upper-most deck for "sea duty". It is outfitted with the necessary moorings to secure the LCAC to the platform.

As a terminal for cargo discharge/loading, the $L^4$ system platform serves the function of keeping the LCAC secured during cargo discharging or loading operations to/from the ship's decks. Extra platform strengthening is provided for the LCAC's ramps touch-down zone.

In the lowered position as a ramp linker, the platform serves as a base to receive the ramps of other vessels. Once the platform and the ramps are connected (married) roll-on/roll-off operations can commence between the vessels from either direction. Besides linking to the ramps of other vessels while at sea, the $L^4$ system platform is capable of linking to floating naval causeways, and with the use of the med-moor ramp, this capability is extended to piers and wharves.

The platform using its med-moor ramp interfaces to shoreside docks when the ship's stern faces the dock ("med-moored"). With the platform level with the pier, together with the lowered backstop fold-up gate and the extended med-moor ramp supported by the pier, this feature allows for a shoreside vehicular cargo (jeeps, tanks, etc) access to/from the ship. Most notably, this feature would be most useful for embarking or disembarking amphibious lighters such as the LCAC to/from a wharf/pier to/from any deck level above the pier.

The platform has flexible construction dimensions. The $L^4$ system is not required to assume any specific dimension until it is predicated on the type and size of vessel to be equipped with the $L^4$ system, and the size and type of cargo, vehicle, ramps and dock linkages the system is to service. Examples of this versatility are provided for the LCACs as applied to the LPD (San Antonio Class), the T-AKR (Bob Hope Class), and the LSD (Harper's Ferry Class). In these specific cases, though the cantilevers and machinery particulars vary, the platform dimensions are selected to be suitable for the U.S. NAVY LCAC size, mass properties and operation.

In furtherance of its features for water shedding and cushion air pressure maintenance, the platform consists of a matrix of through-deck drainage ducts, each equipped with a valve to either permit or prevent drainage of seawater or air. All the valves are simultaneously operated from a master console located in the control room of a cantilever. There are two purposes for this duct feature. The first is to release the air cushion pressure from the landed LCAC (or similar) thus ensuring that the on-skid vehicle will not slide from adverse sudden wind effects while in vertical transit or unanticipated platform malfunction. Once the LCAC is raised to the deck of embarkation, the ducts close in order to restore the LCAC's air cushion allowing for self-propulsion to taxi.

The second purpose of the ducts is to provide a pronounced vertical run-out of seawater off the platform when being raised from underwater, or while submerging it, to provide more rapid increase and distribution of flooding waters. This proper flow will ensure that the landed LCAC's mooring will not be stressed with the otherwise aft run-out wash from the platform immersion and emersions operations. Optionally, depending on the particular requirements of the LCAC or similar, the drainage ducts can be substituted by a matrix of louvers that open or close the air/water passages. They accomplish the same results as the ducts.

The platform is configurable for various options to prevent static or disabled LCAC blockage. One option is the use of existing auxiliary vehicle movers. The platform and the stowage deck will be designed to accommodate the present transfer systems as found on land bases. They may consist of ordinary pusher or puller tugs, tractors or dollies. This method would virtually duplicate those transfer operations onto the $L^4$ system equipped vessel. In this option, the platform's design is dependent on the detailed specification of the transfer equipment and its operation.

A second option is a hydraulic jack dolly. If this option is desired, the platform will be arranged to have four longitudinal recessed runners that tie in with the upper deck's runners when raised to that height. These runners would serve as guides for the upper deck wheeled dolly, which would be self powered or winch-able from the cantilevers to transfer any static or disabled LCAC onto the platform for lowering into the sea. While the static or disabled lowered LCAC is floating, it will be re-moored out of the platform's way in order to continue the sequenced launching operations. This described transfer will be accomplished by the dolly slipping under the static or disabled LCAC, then lifting it with its integral hydraulic jacks, and finally transferring it to the platform for debarkation. This capability ensures that a static or disabled LCAC on the upper decks will not frustrate or interfere with the unloading of the remaining LCACs. Conversely, the dolly will be able to take a static or disabled LCAC off the platform and transfer it to a position on deck for repair, maintenance or return home, etc.

A third option is the use of roller drum runways. This platform is equipped with a series of sequential roller drums, such that when the LCAC lands on the awaiting platform, its skids make contact with the rollers thus allowing the LCAC the necessary guidance for forward or aft transfer. The LCAC taxies, either under its own power, or if static, is transferred by powered drum if incorporated or by wire winching to its parking slot. In the event that the landed vehicle is of a wheel or track type, the roller drums can be locked from rotation in order to permit traction for the self-powered vehicle. The drums as noted are rotated by electric or hydraulic motors. Piezo sensors will activate the motors as the roller is loaded and deactivate once the load is released.

Platform resistance reduction leading edge shape is an important feature. Since the $L^4$ system equipped vessel requires steerage and thrust for heading and maintaining a head wind position in order to facilitate an LCAC approach onto the lowered platform, the platform is specially designed to withstand the streamline flow of approx 5 knots and the ship's propeller wash. This is accomplished by reinforced double runners up the inward sides of the cantilevers and extra strengthening of the platform's pillars, and by the use of a hydrodynamic shaped leading edge of the platform as determined by model testing.

In furtherance of safety, a backstop fold-up gate on the stern of the platform is designed so as to prevent an LCAC from falling overboard during platform operations entailing LCAC backward movement. Another safety feature is that the platform operation is constrained so as to avoid any possibility of collision or interference with other ship systems such as the ship's stern gates. Additionally, the $L^4$ system is completely outfitted with the necessary automatic sensors and lockout devices, lighting, send-off/approach navigation, communications, fire-fighting, local self-defense, mooring and positioning equipment to integrate with the ship's physical arrangements and warfighting capabilities.

Finally, the platform serves as a lifting and positioning mechanism used in the assembly and placement of cross bridges for the erectable trolley/gantry cranes spanning the cantilever's winch deck. These general purpose cranes are used for maintenance and repair when there is need for high clearance.

The cantilever pair component of the $L^4$ system comprises the following unique features and functions:

a. A structural support for all platform movements and operations;
b. Restraining guidance for the platform's wheel guides, which ride within vertical recesses in the cantilevers;
c. Out of the way locked stowage of the platform while underway;
d. Offset of cargo and traffic operations to be clear of ship's propellers and rudder;
e. Housing for all hoisting and control machinery;
f. Command of all platform cargo/traffic operations from a control station;
g. Safe haven shielding LCAC (or similar) recovery and launching operations from adverse seaways;
h. Supports for a cantilever span bridge trolley crane, when desired, to provide lifting and replacement of LCAC (or similar) parts and equipment;
i. Horizontally recessed open deck area within the inboard sides of the cantilevers to provide safety and workspace to mooring crews operating the winches and cleats, located on the platform pillars. This feature will position the LCAC in the desired orientation for lifting;
j. Outfit with all support functions such as firefighting, lighting, communications, machine gun emplacements and etc;
k. Accommodations for surge troops;
l. Ballast, fuel or void space as mission dictated;
m. If the intended $L^4$ system candidate vessel requires improved directional stability, the cantilevers have the inherent design capability to be extended to the ship's baseline, thus serving as hydrodynamic skegs.
n. The cantilever forward edges are scalloped to avoid hard spots resulting from maximum bending deck stresses.

Referring to examples of the application of the $L^4$ system to specific U.S. naval vessels, the LCAC ENHANCED LPD is an LPD with the addition of the $L^4$ system, which expands the LPD's LCAC delivery capacity from two (2) to five (5). This is accomplished by using the existing helo landing spot for the stowage space of two additional LCACs, and using the $L^4$ system platform for stowing the third. With these LCAC additions and the existing capacity of two LCACs in the LPD's well deck, this vessel would function in the same manner as the LPD, but with increased LCAC capacity After the upper-most deck is cleared of the LCACs, normal helo operations can resume on the reclaimed landing spots.

As a different example, the LPD LCAC TRANSPORTER is an LPD derivative which delivers eight (8) standard LCACs in lieu of the existing LPD's two (2) standard LCACs. It shares the same LPD hull, but has only a forward superstructure and a considerably redesigned internal arrangement to carry four LCACs instead of two. The additional four are carried on the upper-most deck in lieu of the aft superstructure and helo landing spot. The described LPD $L^4$ system-equipped variants can have similar counterparts in such Navy vessel types as the LHAs and LSDs, or any qualifying vessel with a transom stern. And again, if the upper-most deck is clear of the LCACs, helo operations can be commenced on the reclaimed landing spots.

Also, as an example of $L^4$ system application, the T-AKR AUTO-DISCHARGER is a modified T-AKR vessel, which can transport, land, load, discharge and re-deploy LCACs. Two variants are considered, both requiring the removal of the existing stem ramp. The first carries three (3) LCACs, a single LCAC on its elevator and two LCACs on-board, while the other carries only a single LCAC on its elevator platform and requires minimal hull modification. Both variants utilize the hull forms of the existing T-AKR.

The $L^4$ system offers leveraged benefits to theaters of operation. The $L^4$ system addresses two needs. The first is to reduce the number of ships dedicated to the delivery and formation of an LCAC force. By providing an $L^4$ system to an LCAC delivery ship such as an amphibious LPD, the enablement of the carriage of additional LCACs on its upper-most decks has minimally the effect of doubling of its carrying capacity, thus resulting in halving the number of committed ships. The LPD LCAC TRANSPORTER accomplishes this mission. Hence, with a greater number of LCACs, the fewer sorties each LCAC would need to perform for a given mission (improving reliability), or conversely a greater number of sorties can be planned for a greater envisaged mission strategy.

The second need addresses the Seabasing necessity to load and deploy an LCAC in a challenging mission sea state environment. The $L^4$ system provides a cantilevered enclosed landing platform, which protects the recovery, and lifting of an LCAC to any upper deck level. Besides the shielding offered by the cantilevers, the effects of the seaway are also significantly attenuated while the vessel points into the seaway during LCAC phases of landing or launching. Once out of the water and secured, the LCAC is loaded with mission cargo; and after loadout and lowering into the water, it is directly launched from the ship's $L^4$ system. This operational cycle is accomplished without resort to a Roll-on/Roll-off Discharge Facility (RRDF), or an Intermediate Landing Platform (ILP), or a Mobile Landing Platform (MLP). This scenario is exemplified by the T-AKR AUTO-DISCHARGER.

Once all of the ship's LCACs have been launched, the $L^4$ system equipped ships become networked "At-Sea Sustainable Platforms" with the deployed LCACs serving as alternative/auxiliary High Speed Connectors (HSC) to other Sea-based ships and land depots. Using the LCAC interfaces, these reconfigured vessels could then serve as terminals for receiving, assembly and launching helicopters, or terminals for M1A1 tanks for subsequent LCAC delivery, or distribution centers for reclaimed war assets, or processing and MEDIVAC facilities of battlefield wounded, or as refueling, maintenance, overhaul and repair resources for the LCACs, and etc. The suggested sustainability of "persistent presence" afforded by the $L^4$ system strengthens the Maritime Prepositioning Force (Future) ("MPF(F)") strike group and leverages the LCAC's integration with the Seabasing mission.

For the purposes of logistical setup (strike-up/down), transport, or stowage, the $L^4$ system platform is also capable to accept and link with the stem ramps of intended High Speed Connectors (HSC) similar to the High Speed Vessels (HSV) used to balance the seabase materiel. The $L^4$ system is not confined exclusively to LCAC operations. It not only can service a variety of lighters, but can also re-characterize the delivery vessel once on station as described.

With an escalated LCAC presence, logistics vessels equipped with the $L^4$ system evolve an amphibious character that can be rapidly discharged at sea, without need of a shore-side dock, and be released from station for a quicker re-delivery of war supplies to the seabase. By example, the T-AKR AUTO-DISCHARGER offers a faster turnaround.

The inventive $L^4$ system has been shown to be not only a unique solution to the limitations described but is also a substantial leveraging facility that solves various seabome connectivity issues within the U.S. Navy Seabasing Concept. The $L^4$ system is shown to be retrofitable and economical to several classes of U.S. naval ships as well as being an integral part of a new vessel design. The $L^4$ system is unique and is a helpful, if not a necessary adjunct to U.S. naval amphibious design and operations.

BRIEF DESCRIPTION OF THE DRAWINGS

FIG. 5 is the basis for the initial weight estimate shown above FIG. 6.

FIG. 6 is table showing of proposed shapes and plates and the resulting final weight estimate of the platform as depicted in FIG. 5.

DETAILED DESCRIPTION OF THE INVENTION

The $L^4$ system for recovery comprises four LCAC positioning winches 32, as necessary LCAC line retrieving winches, an LCAC elevator platform 1, and LCAC stowage fittings and restraining devices on the platform itself.

The dockmaster supervises the LCAC 21 landing and take-off through communication with various operators, LCAC crew, and line handlers by means of an announcing system. Red, green, and amber traffic lights visible to the approaching LCACs are located on the stems of the port 52*b* and starboard 52*a* cantilevers. These traffic lights are controlled from the $L^4$ system control command station 44 located on the main deck 57 within one of the cantilevers. LCACs 21 are able to be carried by the platform 1 when it is in the "at sea" stowed position. Though single LCAC lifting capacity is normal, if the smaller units present themselves and can be secured, then a multiple lift is possible providing weight limits are not exceeded.

Figure 1:
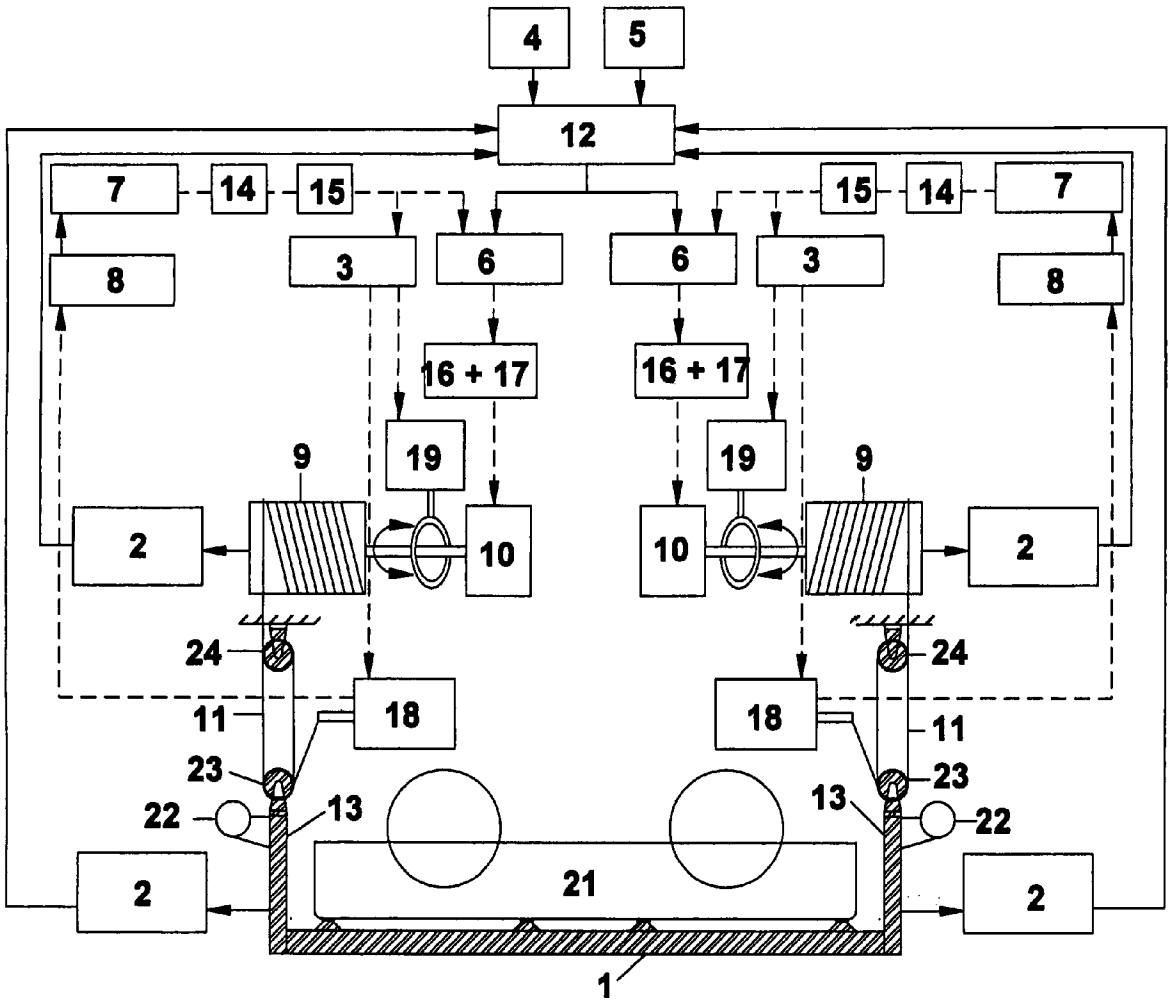
FIG. 1 presents a notional machinery schematic of the Elevator Hoisting System, Elevator Platform and Winch Assemblies, which demonstrates the $L^4$ system's capability to raise, hold and lower the platform.

FIG. 1 presents a notional schematic of the Elevator Hoisting System, Elevator Platform and Winch Assemblies to substantiate lifting capability. It is not intended that the inventive system be limited to the embodiment shown in FIG. 1 as it is only one possibility of many other dynamic solutions and several alternative lifting mechanisms may be used.

The Elevator Hoisting System as shown in FIG. 1 comprises a platform 1 and an electro-hydraulic hoisting machinery arrangement (the "hoisting system"), provides power to smoothly raise and lower the LCAC (or similar) 21 platform 1 between the landing level and any higher deck, and maintains the platform 1, loaded or unloaded at any selected level. The platform 1 is a single, full width structure between the cantilever wingwalls at the stem of the ship.

The hoisting system comprises electromechanical position transducers 2 which provide electrical signal to the feedback control loop, auxiliary pumping units 3, control panels 4, alarm panels 5, main electro-hydraulic pumping units 6, reserve oil tanks 7, heat exchangers 8, a plurality of winch cable-drums 9, a plurality of winch assemblies 10, a plurality of lifting wire ropes 11, and at least one elevator control console 12. Though the hoisting systems power is from the ship's service generators, it can be operated independently from its own auxiliary diesel/generator set and/or shore power.

In the embodiment depicted, there would be eight winch cable drums 9, four winch assemblies 10, 32 lifting wire ropes 11, and one elevator control console 12.

As depicted in this embodiment, the hoisting system can lift and lower the weight of the platform 1 including eight sheaved pillars 13, wire ropes 11, the backstop fold-up gate, med-moor ramp, a payload of at least 300 LT, wind loads, wave loads, and dynamic loads from the movement of the ship. If a component fails, the redundant system can be still be operated by isolating the defective component and continuing the operation with the remaining equipment. If necessary, the elevator can be operated with a reduced number of main pumps for complete cycle full load, but on a longer time cycle. The hoisting system can also be used with less than a full complement of winch motors, but at a reduced load.

The hoisting system provides the required means and power to smoothly and efficiently raise and lower at least one fully loaded LCAC 21 and the outfitted platform 1 between the submerged landing level and the LCAC stowage levels. In addition, the platform 1 supports the loading and unloading of cargo from the thereon positioned LCAC 21.

When the hoisting system is started, hydraulic fluid is drawn from the cantilever's reservoir assemblies 7, one starboard and one port, by the circulating pumps 14 and pumped through the main system filters 15 to the suction ports of the auxiliary pumps 3 and main system pumps 6. This circuit incorporates various relief valves, solenoid-operated valves, and pressure switches.

The main system pumping circuit is a closed loop, drawing makeup fluid from the circulating pumps 14 only to replace fluid lost through leakages of the valves, hydraulic motors, and pumps. All system leakage is routed through the heat exchanger 8 for cooling before being returned to the reservoirs 7.

The axial-piston, fixed-volume hydraulic motors 16 drive the winch rope drums 9 through the gear boxes, each of which is equipped with two hydraulic motors 17 that drive two rope drums 9 mounted on either side of the primary gear box.

The dead end of each pair of ropes 11 is attached to a hydraulic snubber 18 on the winch assembly 10. The snubbers 18 are used to equalize the load between the drums 9, and act as shock absorbers and load limiting devices.

A pair of mechanical spring-set, hydraulic release brakes 19 on each winch assembly is attached so that the hydraulic motor shafts 20 are prevented from turning when the brakes 19 are set. The brakes 19 lock the elevator platform 1 in place.

The platform 1, as schematically depicted in FIG. 1 and depicted in FIGS. 2-14 is a single, full-width platform 1, which travels up and down within the stem cantilever wingwalls, has a plurality of sets of guide wheels 22 and a plurality of wire rope lift points attached to the pillars 13 to hold the platform 1 in alignment and prevent fore/aft movement. In this embodiment, the platform 1 has four sets of guide wheels 22 and eight wire rope lift points. The wheel guides 22 are fitted into the vertical recessed runners of the each cantilever. Each suspension point has a double wire rope, six-part lift with the ropes 11 reeved from the winch drums 9 around the three lower 23 and two upper sheaves 24. The dead end 11 is brought from the third lower sheave 23 to the winch assembly 10 anchor points, which have hydraulic snubbers 18 to limit overloads.

Figure 10:
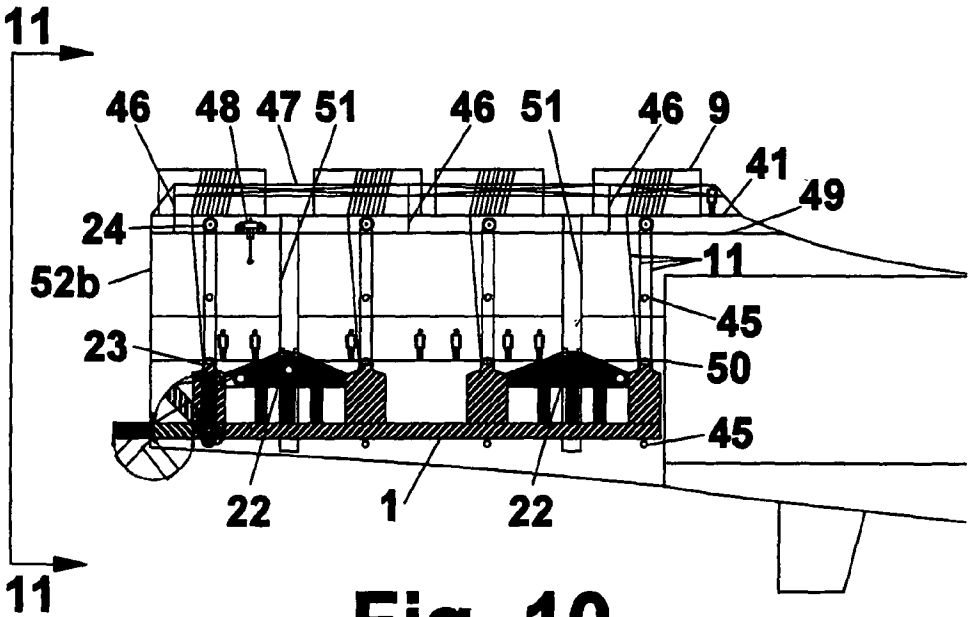
FIG. 10 shows the general arrangement of inboard side of the port cantilever where a recessed deck is shown to maintain a mooring capability for the arriving/departing LCACs. Also, the two parallel vertical recessed rails for the platform wheel guides are shown. In addition, a trolley truss is shown for the erectable trolley/gantry cranes spanning the cantilever's winch deck.
Figure 11:
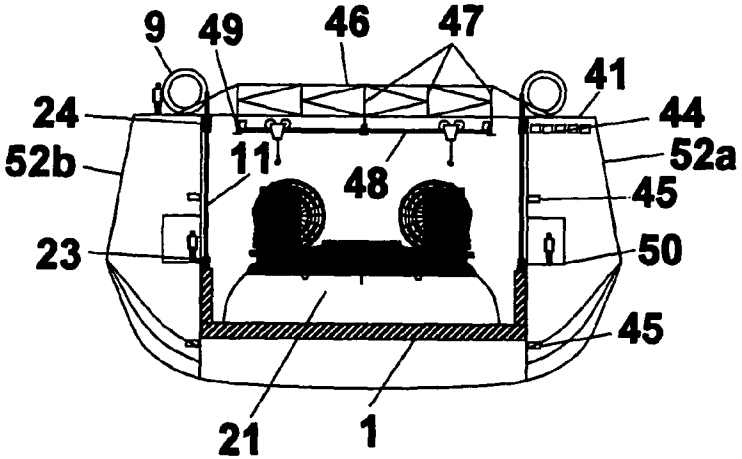
FIG. 11 is an aft view looking forward in the direction shown by line 11-11 of FIG. 10. An LCAC while on cushion is resting on the platform, ready to be decompressed and lifted. The shown bridge truss gives notional minimum overhead clearance available while the LCAC is on cushion.

When the elevator is not in use, the platform 1 is stowed at the upper-most deck level supported on a plurality of hydraulically actuated locking pins 45 as shown in FIG. 10 and FIG. 11 emanating inwards from the cantilevers to restrain the loaded/unloaded platform 1 under maximum storm conditions. In this embodiment, the platform 1 is supported on eight hydraulically actuated locking pins 45. The hydraulically actuated locking pins 45 are provided to prevent inadvertent operation of the platform before all operating conditions are met. The hydraulic actuated locking pins 45 prevent:

a. Operation of the elevator when the pins 45 are extended from the cantilevers and into the platform's base receptacle, except to raise the platform off the locks for retraction into the platform.
b. Pin operation, except when the platform is at the termination deck level.
c. Retraction of the pins when a slack rope condition exists.
d. Operation of the elevator in LCAC 21 launching or recovering areas during operations.
e. Operation of the elevator during operation of the trolley/gantry repair crane.

A plurality of winch assemblies 10 hoist the platform 1. In this embodiment, there are four winches 10, two on each cantilever (port and starboard) to hoist the platform 1. The two starboard winches 10 are driven by the starboard hydraulic system, the port winches by the port hydraulic system. Piping for the two hydraulic systems is not cross-connected. Balancing and synchronization is accomplished by an electrical feedback synchronization system provided by the electromechanical position transducers 2 to keep the platform level to aid in the loading, lifting, and unloading of LCACs 21. Each winch assembly 10 has two drums 9, driven by hydraulic motors 17. Each drum 9 has a pawl device that can be manually engaged to prevent lowering of the platform 1. The transducers 2 are used as feedback loops to signal to the control system 12 the position of the platform 1.

Figure 2:
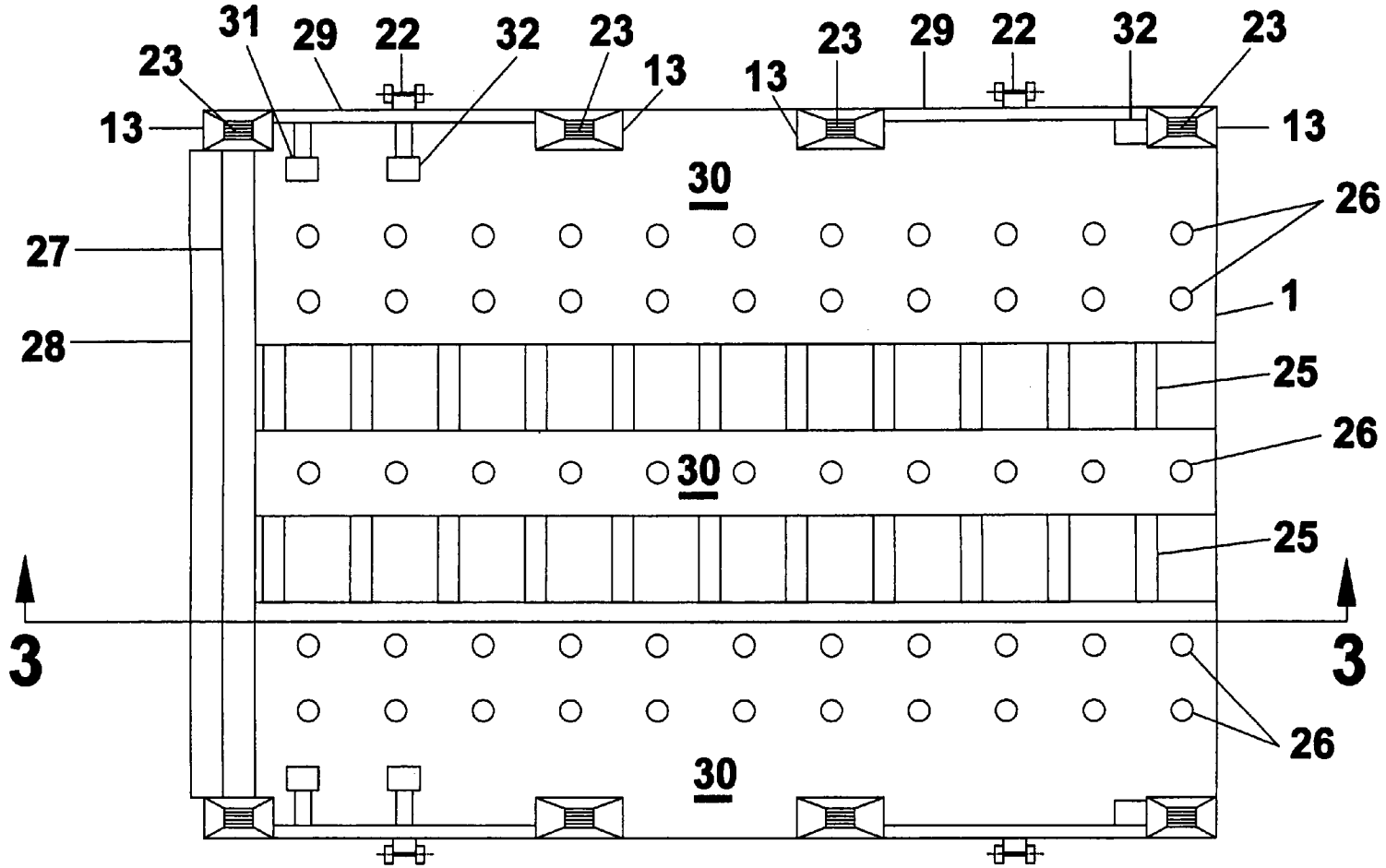
FIG. 2 is a plan view of the proposed platform component of the $L^4$ system. Some of the shown unique features of this platform include a motorized roller-drum conveyor, water and air compression control ducts, and a backstop fold-up gate with a hinged med-moor ramp. The depiction of the backstop fold-up gate is in the stowed upright position with the med-moor ramp in contact and secured to its underside.

FIG. 2 is a plan view of the proposed platform 1 component of the $L^4$ system. Some of the shown unique features of this platform 1 include a clockwise or anticlockwise rotating motorized series of roller-drum conveyors 25, seawater drainage and cushion air control ducts 26, and a stowed backstop fold-up gate 27 with a hinged med-moor ramp 28 and a plurality of intermediate pillar brackets 29 on each side of the platform 1 which support the wheel guides 22. In this embodiment there are four intermediate pillar brackets 29 (two on each platform side) which support the wheel guides 22. Though deck plate 30 is present overall, the platform's deck plate 30 in way of the roller drums 25 is not shown so as to better expose the drums' 25 arrangement and size. The starboard side is unnumbered as it is symmetrical to the port side description.

During an LCAC 21 embarkation from sea, in a typical landing and lift cycle, the elevator operator, stationed at the elevator control console 12 in the control station 44 of one of the cantilevers, lowers the platform 1 with its backstop fold-up gate 27 in the down position (horizontal) and med-moor ramp 28 stowed, to a depth below the surface of the water which will permit the approaching off-cushion LCAC 21 to float above the platform 1. However, when the LCAC 21 is in normal operating condition, that is on-cushion, i.e. airborne, the platform 1 need not be submerged. It could be positioned up to three feet above the water surface and still receive the approaching on-cushion LCAC 21. The control station 44 has windows looking inboard and aft so that the operator can ensure meeting all operating and safety objectives and view the platform 1 in motion.

While the platform 1 is in the receiving position, either submerged or emerged, the LCAC 21 is properly aligned over the platform 1 by a plurality of positioning winches 32 operated by the ground crew working in the recessed mooring deck of the cantilevers. The positioning lines are placed over the LCAC's 21 bollards/cleats, and the strain is taken by the positioning winches 32. A winch operator controls all the positioning winches 32 from a central point on the cantilevers winch deck 41. He is responsible for correctly positioning the LCAC 21 fore and aft and ship centerline alignment. The positioning winches 32 are preferably located at the platform's 1 corners. In combined winch operation 32, the waterborne or airborne LCAC 21 is ultimately maneuvered into alignment.

When the LCAC 21, engines idling or off, is properly positioned and is secured to the cleats on the pillars 13 by the stationed mooring crew, the elevator operator engages the motor winches 31 to lift up the backstop lift-up gate 27 to the vertical position, opens the seawater drainage and cushion air control ducts 26, and then begins to raise the platform 1. The elevator will automatically stop at the deck level selected by the elevator operator. There the LCAC 21 lines can be released, the platform drainage ducts 26 closed to permit airborne transit, and with its engines restarted, if they were shut down, the LCAC is ready to be stowed airborne onto the ship or be loaded with ship cargo while off-cushion. Should the LCAC 21 be without power, the mechanized roller drums 25 in contact with the LCAC skids will stow the craft. For LCAC 21 debarkation (launching), the described procedure is reversed.

Figure 3:
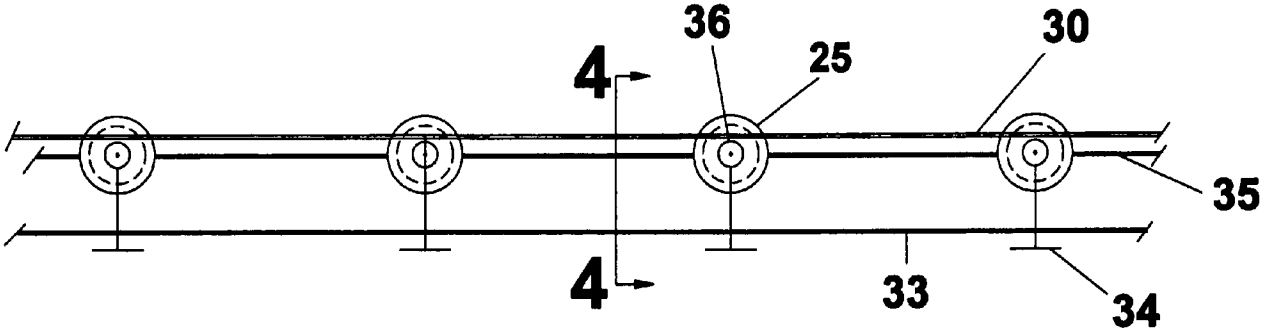
FIG. 3 is a cross section as taken through line 3-3 of FIG. 2 and shows a side view of the conveyor typified by transversely paired motorized roller-drums and their intended support structures.

FIG. 3 is a cross section as taken through line 3-3 of FIG. 2 and shows a side view of the conveyor typified by transversely paired motorized roller-drums and their intended support structures. As depicted in this embodiment the longitudinal primary structure consists of 30" T-girders 33 while the transverse primary structure consists of 36" T-beams 34. The longitudinal deck stiffeners 35 are WT 155×10.5 and the deck is of 30.6# plate 30. While these structural elements are mild steel, alternative structural components and materials might be used. Each transverse pair of roller-drums 25 is turned by a common shaft 36, which in turn is driven by a motor and gear. The purpose of the roller drums 25 is to support and hold the LCAC 21 via its skids and when desired to act as a conveyor to transport the landed vehicle forward or aft. The platform 1, when outfitted with this conveyor, should lead to a continuation of the conveyor on the receiving ship's deck.

Figure 4:
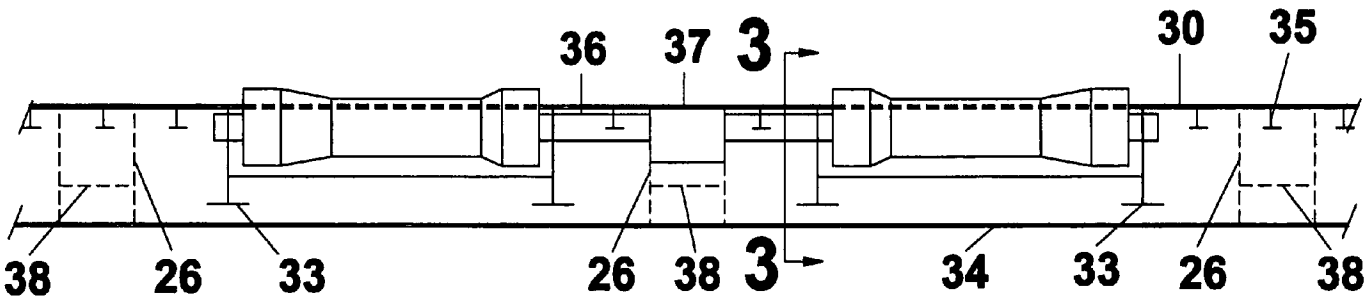
FIG. 4 is a cross section as taken through line 4-4 of FIG. 3 and presents a frontal view of a typical pair of motorized roller-drums, the motor, the gearing, and the common shaft. The drums are shaped to restrain vehicle excursions from the intended track while being conveyed.

FIG. 4 is a cross section as taken through line 4-4 of FIG. 3 and presents a frontal view of a typical pair of motorized roller-drums 25, seawater drainage and cushion air control ducts 26, the controlling remote operating valves 38, the driving motor and the gearing 37 for the common shaft 36. The drums are beveled-shaped to maintain the transported vehicle on the intended track. Also, shown in this embodiment is the construction member support system consisting of the longitudinal 30" T-girders 33, the transverse 36" T-beams 34, longitudinal deck stiffeners 35 of WT 155×10.5 and the 30.6# plate 30 of the deck. While these structural elements are mild steel, alternative structural components and materials might be used. This structure surrounds and supports the motorized roller-drums 25.

Figure 5:
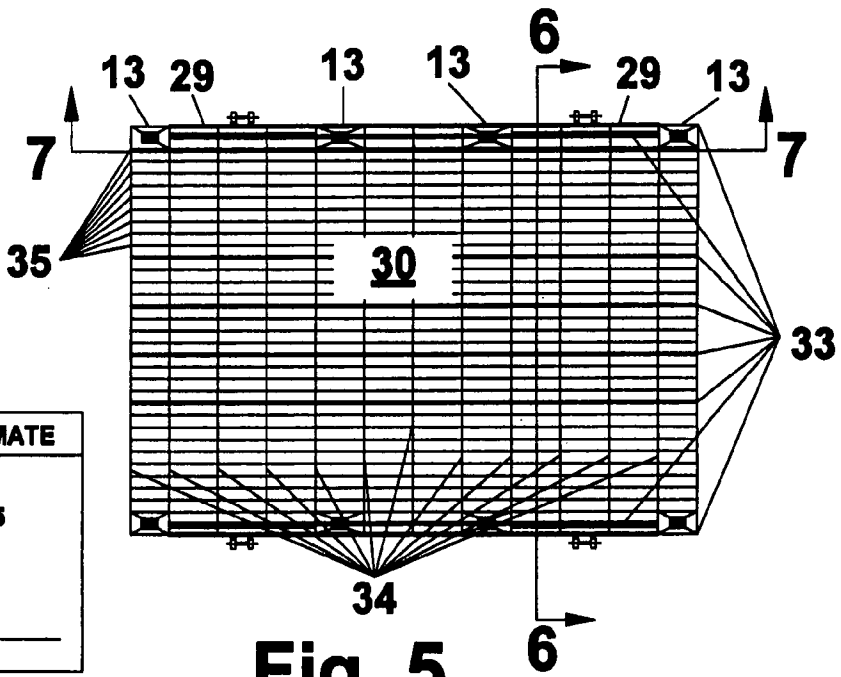
FIG. 5 shows a plan view of the platform's general plating, stiffener requirements, and lifting pillar arrangements of the platform.

FIG. 5 shows a plan view of the platform's general plating, stiffener requirements, and lifting pillar arrangements of the platform. This figure together with the other views is the basis for the initial weight estimate. The embodiment shown in FIG. 5 depicts the following structural elements for the steel weight structure: platform plate 30, sheaved pillars 13, intermediate pillar brackets 29, 30" longitudinal T-girders 33, transverse 36" T-beams 34, and the longitudinal deck stiffeners 35. The arrangement is provided to show the anticipated strength requirements against buckling and tension stresses. The backstop fold-up gate and med-moor ramp are not considered to be contributory to the strength, so are omitted from the figure.

Figure 6:
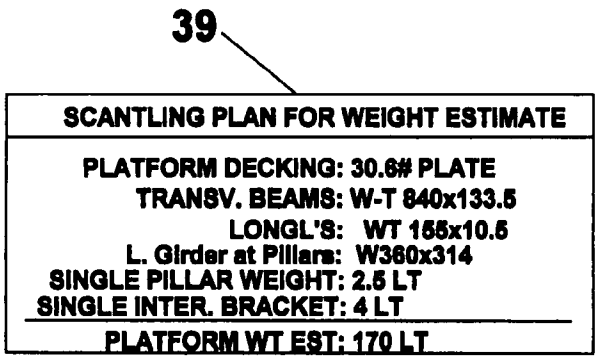
FIG. 6 is a cross section as taken through line 6-6 of FIG. 5 and gives a cutaway frontal view of the platform to establish the position of the wheel guides and their proposed engagement to vertical runways recessed in the cantilevers. Also, above
Figure 6:
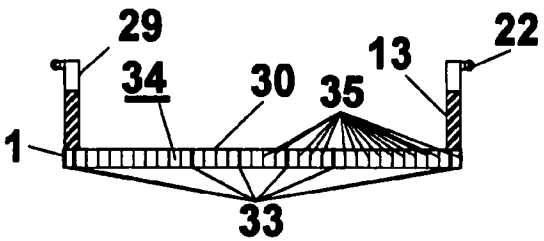

FIG. 6 is a cross section as taken through line 6-6 of FIG. 5 and gives a cutaway frontal view of the platform 1, to show the position of the wheel guides 22 and their proposed engagement to vertical runways recessed in the cantilevers. Also, presented above the figure is a weight estimate table 39 showing of proposed shapes and plates and the resulting final weight estimate of the platform 1 based on mild steel components.

Figure 7:
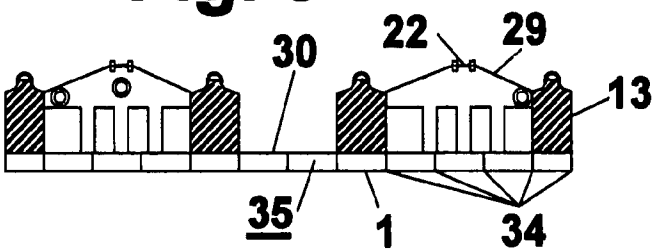
FIG. 7 is a cross section as taken through line 7-7 of FIG. 5 and illustrates the side view of the portside four pillars crowned with cable sheaves and interspersed wheel guides mounted on support plates. These pillars together with the starboard ones are components of the given tabular weight estimate shown above FIG. 6.

FIG. 7 is a cross section as taken through line 7-7 of FIG. 5 and illustrates the side view of the portside pillars 13 crowned with cable sheaves and interspersed wheel guides 22, which are shown as a male fit, mounted on intermediate pillar brackets 29 and other views of the structural members. The winches are drawn on the intermediate pillar brackets 29 but are unnumbered as they are not included in the tabular steel weight estimate table 39. They are considered machinery outfitting and are accounted elsewhere, together with the weights of the backstop fold-up gate and med-moor ramp.

Figure 8:
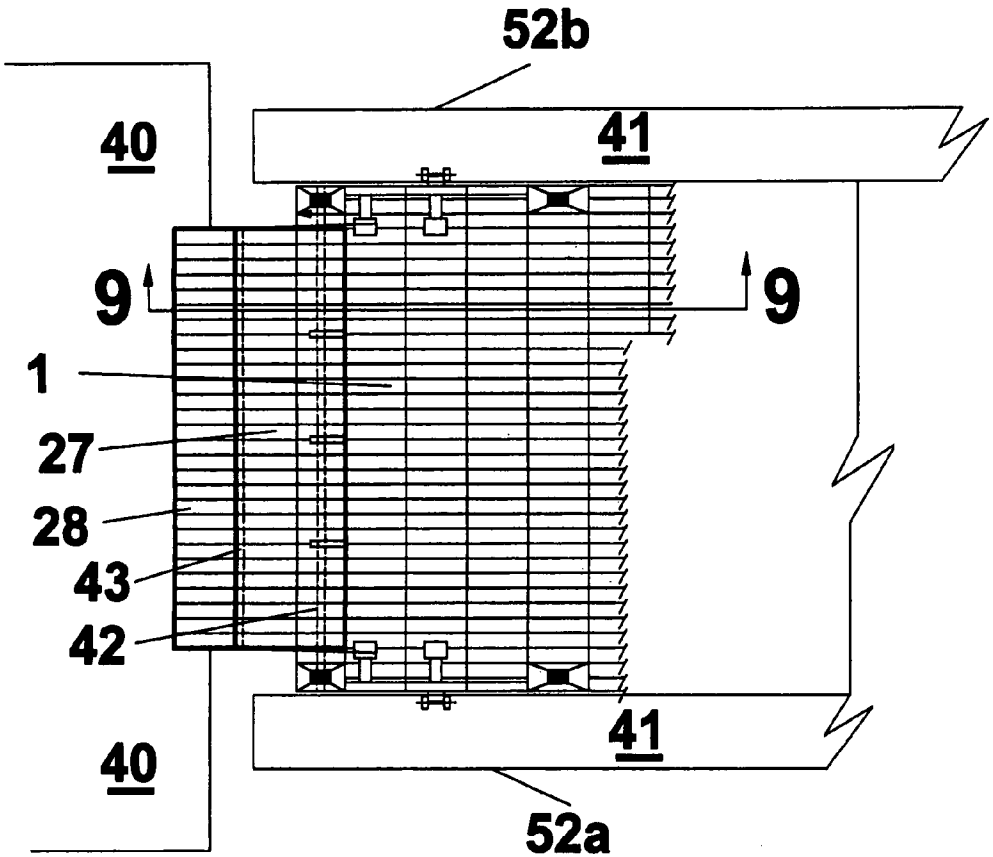
FIG. 8 shows a plan view of the backstop fold-up gate and the med-moor ramp in the deployed position. Note that the ramp is extended aft beyond the cantilevers to ensure a sufficient "bite" on the pier. The med-moor ramp feature is used when cargo operations originate or terminate shoreside to or from the vessel; but this feature is also useful to "marry" to other ramps.

FIG. 8 shows a plan view of the backstop fold-up gate 27 and the med-moor ramp 28, which are attached to the stem of the platform 1, in the deployed position. Note that the ramp 28 is extended aft beyond the cantilevers **52*a* and 52*b* to ensure a sufficient "bite" on the pier 40. The med-moor ramp 28** feature is used when cargo operations originate or terminate shoreside to or from the vessel; but this feature is also useful to "marry" to other ramps.

Figure 9:
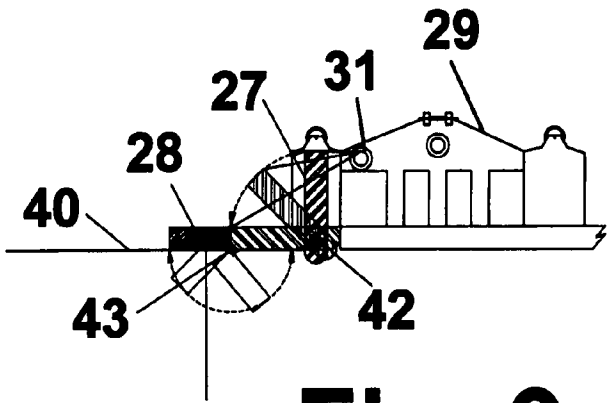
FIG. 9 is a cross section as taken through line 9-9 of FIG. 8 and shows a through side section depicting the swing down operation of the backstop fold-up gate. Additionally, shown is a motorized winch and wire rope assembly attached to the intermediate pillar brackets, which would be used to hoist and lower the backstop fold-up gate and also the med-moor ramp. These brackets to which the wheel guides are mounted are shown to be strengthened, overriding previous figures, with vertical members. The swing-to med-moor ramp is stowed flat against the underside of the backstop fold-up gate.

FIG. 9 is a cross section as taken through line 9-9 of FIG. 8 and shows a through side section depicting the swing down operation of the backstop fold-up gate 27. Additionally, shown is a motorized gate winch 31 and wire rope assembly attached to the intermediate pillar brackets 29 which would be used to hoist and lower the backstop fold-up gate 27 and also the med-moor ramp 28. The swing-to med-moor ramp 28 is stowed flat against the underside of the backstop fold-up gate 27.

During LCAC 21 and vehicular embarkation from a pier 40 when the vessel is moored with its stem to wharf 40, the typical landing and lift cycle is initiated by the elevator operator, stationed at the elevator control console 12 in the control station 44. He lowers the platform 1 with is backstop fold-up gate 27 in the horizontal plane and the deployed med-moor ramp 28 onto to the wharf 40 as in this figure. This will permit the approaching on-cushion LCAC 21 to embark the platform 1. Once embarked, the operation henceforth follows the same alignment procedures as given for the sea arriving LCAC 21; and once aligned, the operation is identical as described. Vehicular cargo arriving from the pier onto the platform 1 can easily be secured and be lifted or lowered to the desired deck where they can resume their flow to be stowed. For vehicular unloading and LCAC debarkation onto a pier 40, the described procedure is reversed.

FIG. 10 shows the general arrangement of inboard side of the port cantilever where a recessed deck 50 is shown to maintain a mooring capability for the arriving/departing LCACs 21. Also shown is that the platform 1 is operated by the winch cable drums 9 pulling on the wire lifting ropes 11 which attach from the lower sheaves 23 on the pillars to the upper sheaves 24 on the cantilever winch deck 41. The platform 1 always tracks along the two parallel vertical recessed rails 51 since the embedded wheel guides restrict excursion.

FIG. 10 also depicts the platform's 1 feature that when LCAC 21 maintenance or repair is needed; a scaffolding truss can be deployed using the platform 1 as a construction enabler. Spanning the cantilever's winch deck 41 is an assembled trolley transverse bridge truss 46 and side supporting truss 47 with suspended longitudinal gantry rails 49 for the erectable trolley/gantry cranes 48. This assembly is facilitated by the platform's 1 ability to lift and hold individual structural members.

FIG. 11 is an aft view looking forward in the direction shown by line 11-11 of FIG. 10 into the cantilevers and platform 1. An LCAC 21 while on cushion is resting on the platform 1, ready to be decompressed, be corralled by the backstop lift-up gate, and be lifted by the winch drums 9 pulling on the wire ropes 11. Mooring personnel are on the cantilever's recessed mooring deck 50 working the LCAC 21 into position while being monitored from the control station 44. As is demonstrated with the truss bridge optionally deployed, the LCAC 21, instead of being lifted to the main deck, is to undergo "in-situ" repair using the overhead travelling gantry with the two trolley cranes 48 riding on the gantry rails 49. The shown transverse bridge truss 46 while supported by side trusses 47 gives notional overhead clearance available while the LCAC 21 is on cushion. Depicted are the hydraulic locking pins 45 to secure the platform 1 when at a terminal deck and their functions have been described with FIG. 1.

Figure 12:
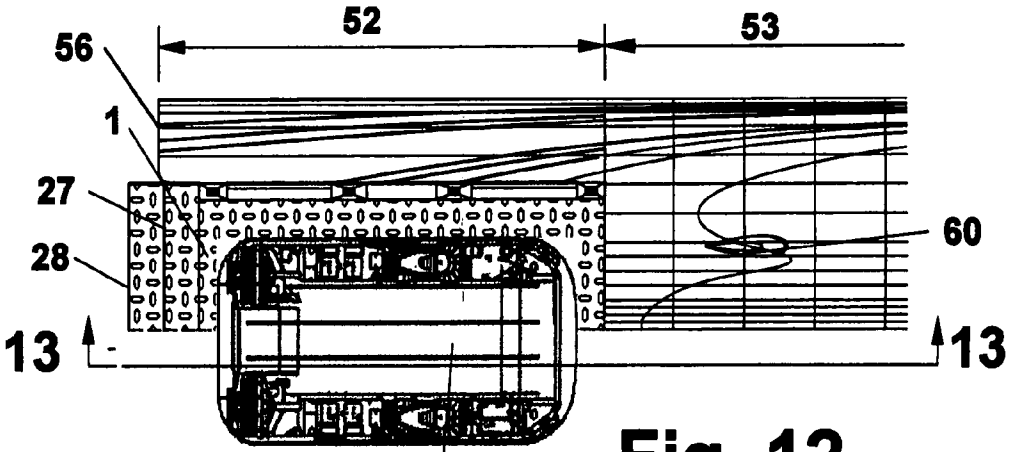
FIG. 12 shows how the $L^4$ system can be faired into an ostensible LPD's afterbody. This design capability is intended to demonstrate a perfect retrofit to the existing vessel. Also, shown in FIG. 12 is the backstop fold-up gate and med-moor ramp fully extended for vehicular traversing. The extension of the ramp is only necessary for pier or other ramp linkage operations; the fold-up gate is in the unfolded condition whenever an LCAC is ready to land or launching from the platform.

FIG. 12 shows a half-breadth plan view of a faired cantilever 52 demonstrating the $L^4$ system's appendage capability as specifically applied to a vessel having a transom stem. This design capability allows for a retrofit to the existing vessel. Also, shown in FIG. 12 is the backstop fold-up gate 27, the med-moor ramp 28 fully extended for the intended vehicular traffic and/or ramp linkages, and the LCAC 58. The extension of the ramp 28 is only necessary for pier or other ramp linkage operations associated with other vessels, while the fold-up gate 27 is in the unfolded condition whenever an LCAC 58 is ready to land or launch on/off the platform.

Figure 13:
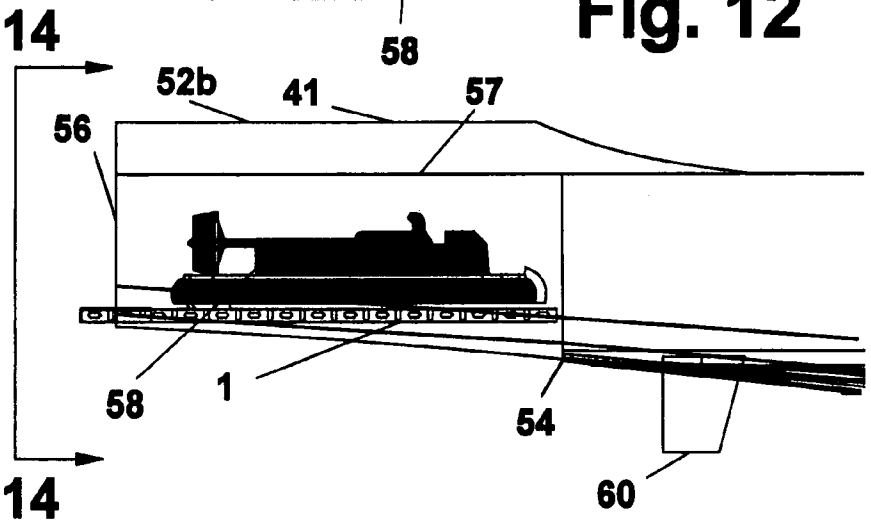
FIG. 13 is a cross section shown by line 13-13 in FIG. 12 to show the buttocks of the fairing capability of the $L^4$ system. The platform is shown to be a normal receiving level for an approaching LCAC.

FIG. 13 is a section cut in the direction of line 13-13 of FIG. 12, to show the buttocks of the fairing capability of the $L^4$ system into a vessel having a transom stem. The platform 1 with the LCAC 38 is shown to be ready for lifting. When required, the submerged platform below the hull is well clear of the rudder 60. Additionally presented is the termination deck, which will be the upper-most deck 57, and the winch deck 41 of the cantilever 52*b*.

Figure 14:
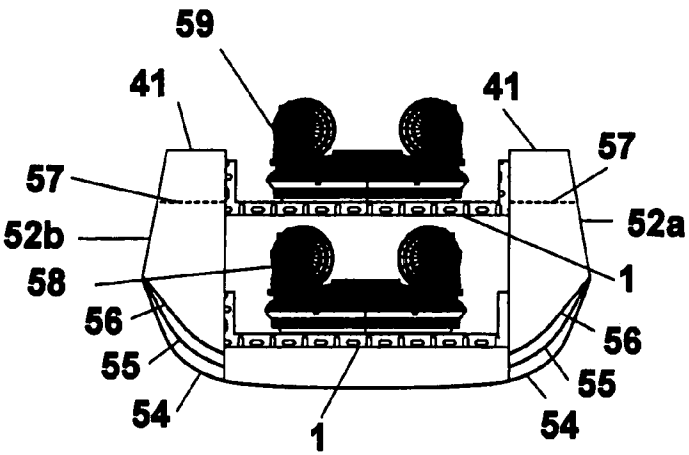
FIG. 14 is an aft view looking forward in the direction shown by line 14-14 of FIG. 13. There are two representations: the first shows an LCAC recovered on the platform ready to be lifted; while the second shows the lifted LCAC, ready to return on-cushion and proceed forward to park. Also depicted are the body section lines of the cantilevers as they emanated aft from the ship's transom.

FIG. 14 is an aft view looking forward in the direction shown by line 14-14 of FIG. 13 demonstrating the faired-in cantilever 52 as body section lines 54, 55 and 56 as they emanate aft from the ship's transom stem 54. Also, there are two successive views of lifting operations: the first shows an LCAC 58 resting off-cushion on the platform 1—ready to be lifted; while the second shows the lifted LCAC 59 at the termination deck—the upper-most deck 57, ready to resume on-cushion propulsion and proceed forward to park under its own power. Note that in this operation, it was elected to leave the backstop fold-up gate and med-moor ramp open, since the LCAC 58 and 59 are positively grounded on skids. In the reversal of this maneuver, the provided backstop fold-up gate is to be upright to positively stop the rearward advance of the LCAC.

Figure 15:
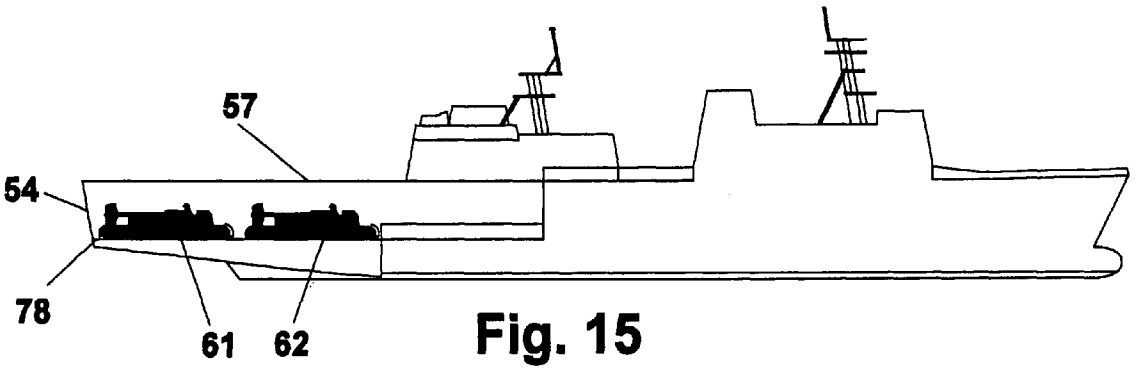
FIG. 15 is a greatly simplified view of the inboard profile of a San Antonio Class, LPD as a baseline candidate vessel to be outfitted with the $L^4$ system. It shows a void two (2) LCAC capacity well deck.

FIG. 15 is a greatly simplified view of the inboard profile of a San Antonio Class, LPD as a baseline candidate vessel to be outfitted with the $L^4$ system onto its transom stern 54. Shown as built, the main deck 57 is used as a flight deck and is devoid of LCAC's and LCAC access. Also shown is the well deck 78, which has two parked LCACs 61 and 62 and is at its full capacity.

Figure 16:
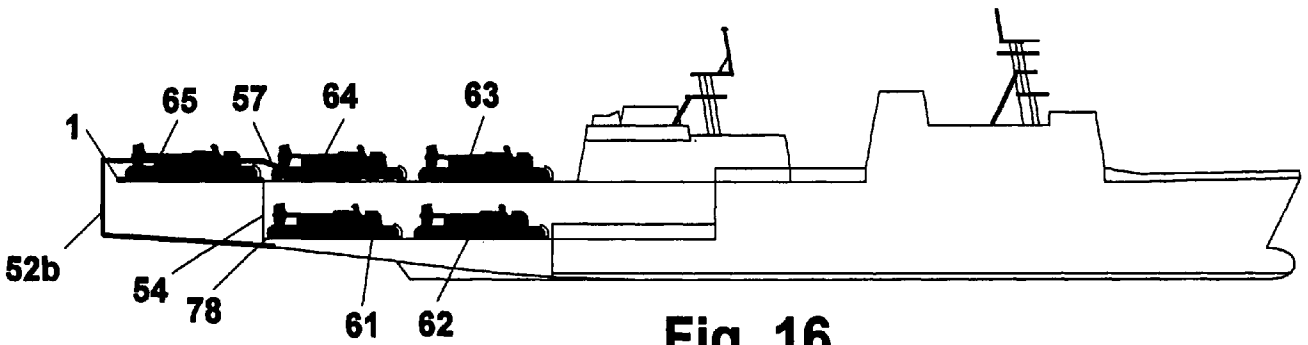
FIG. 16 shows a greatly simplified view of the inboard profile of the notional LCAC ENHANCED LPD, which is virtually the same San Antonio Class LPD but outfitted with the $L^4$ system. The LCAC capacity is now five (5) instead of two (2) by using the upper-most deck and the platform to carry three additional LCACs.

FIG. 16 shows a completed application of the $L^4$ system as a retrofit to an existing vessel. Presented is a greatly simplified view of the inboard profile of the proposed (sanitized) LCAC ENHANCED LPD, which is virtually the same as the San Antonio Class LPD shown in FIG. 15 but appended to the transom stem 54 and outfitted is the $L^4$ system's cantilever 52, and platform 1. The resulting benefit is that the LCAC capacity is now increased to five (5) instead of the two (2) LCACs 61 and 62 on the well deck 78. Access to the main deck 57 has been provided by the $L^4$ system's cantilever 52, and platform 1 to carry the three additional LCACs 63, 64, and 65. The platform 1 provides a permanent stowage location for LCAC 65.

Figure 17:
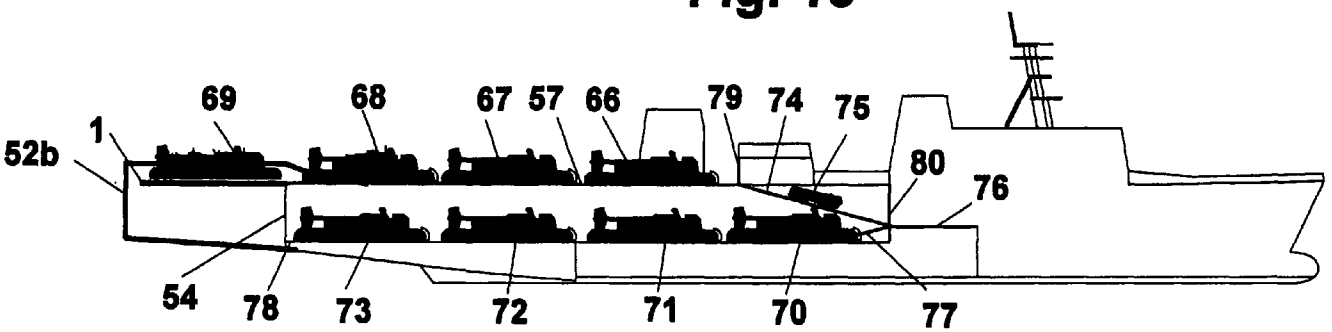
FIG. 17 shows a greatly simplified view of the inboard profile of the notional LPD LCAC TRANSPORTER, which is a substantially modified design of the San Antonio Class, LPD and also outfitted with the $L^4$ system. As a ferry, it can carry eight (8) LCACs. There are four (4) on the upper-most deck and four (4) stowed in the well deck below. Other vessel platforms, outfitted with the $L^4$ system, can be designed to create an even more LCAC dense ferry!

FIG. 17 shows a completed application of the $L^4$ system as a newly specialized vessel but using an existing hull form. Presented is the greatly simplified inboard profile of the proposed notional LPD LCAC TRANSPORTER, which is a substantially modified baseline design of the San Antonio Class, LPD shown in FIG. 15. The $L^4$ system is typified by the cantilever 52, the platform 1 and the vessel's transom stem 54. As a novel amphibious ferry, it can carry eight (8) LCACS. There are three 66, 67, and 68 on the main deck 57 while one 69 is stowed on the platform 1 and four 70, 71, 72 and 73 stowed in the well deck 78 below. Demonstrated with this design is a vehicle 75 descending the main deck ramp 74 to the turn-around traffic deck 76 where it will make a U-turn to continue its transit via well deck ramp 77 to reach the well deck 78 for embarkation to an LCAC. A watertight door 79 located on the main deck 57 at the entrance to the main deck ramp 79 and watertight doors 80 located on the turn-around traffic deck 76 protect the vessel from flooding. The $L^4$ system permits other possible vessel types to be designed to create superior LCAC ferries.

Figure 17A:
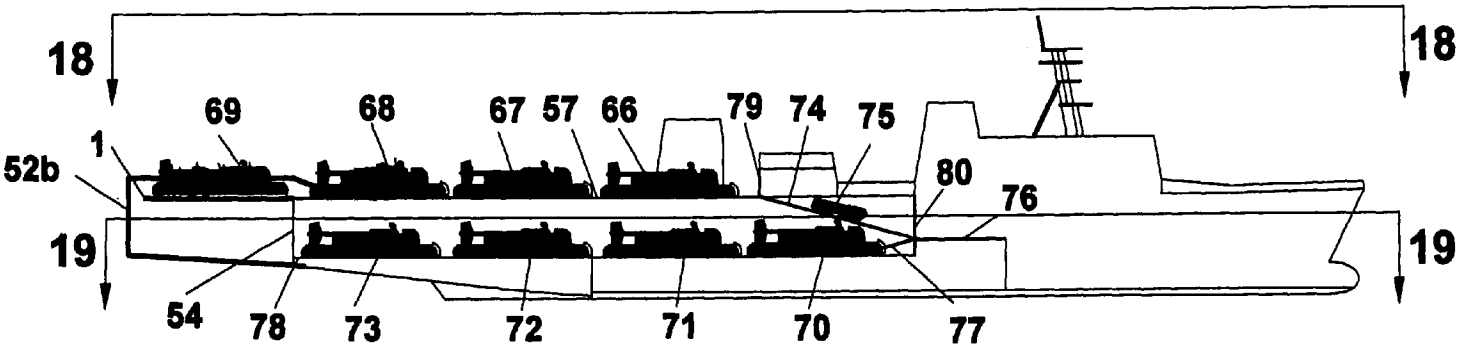
FIG. 17A is a reproduction of FIG. 17 with view lines 18-18 and 19-19 depicted in FIGS. 18 and 19 respectively.
Figure 18:
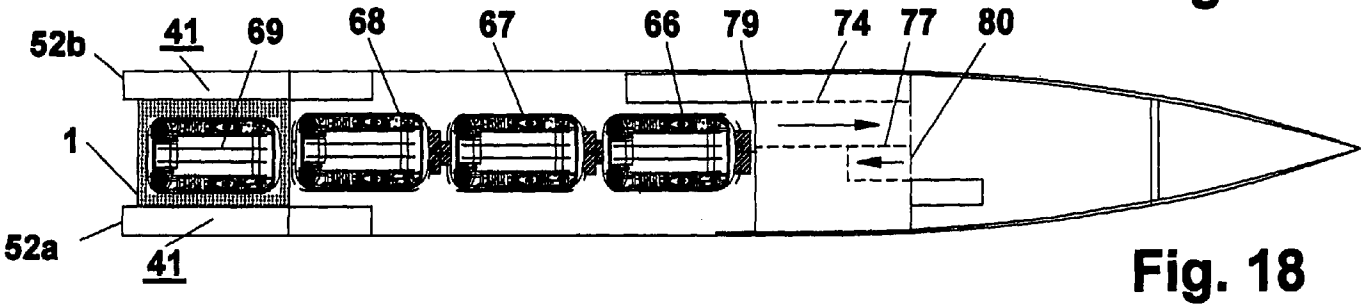
FIG. 18 is a plan view taken in the direction shown by line 18-18 in FIG. 17A to show the redesigned upper-most deck of the LPD LCAC TRANSPORTER. Shown are four to-scale LCACs in tandem on deck to indicate a feeling of additional width to support auxiliary operations such as ground mooring.
Figure 19:
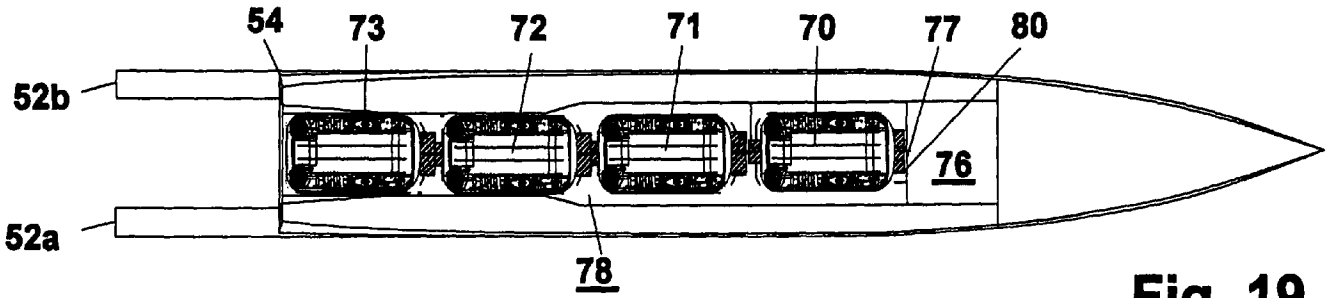
FIG. 19 is a plan view taken in the direction shown by line 19-19 in FIG. 17A to show a redesigned well deck of the LPD LCAC TRANSPORTER. Shown are four to-scale LCACs in tandem to indicate a sense of width and depth into the vessel to support auxiliary operations such as ground mooring.

FIG. 17A is a reproduction of FIG. 17 with view lines 18-18 and 19-19 depicted in FIGS. 18 and 19 respectively.

FIG. 18 is a plan view taken in the direction shown by line 18-18 in FIG. 17A to show the redesigned upper-most deck of the LPD LCAC TRANSPORTER. Shown are four scaled LCACs 66, 67 and 68 in tandem on deck and one LCAC 69 on the platform 1 to indicate the robustness of available width to support new novel extra-wide LCACs and/or any auxiliary operations such as mooring, fueling, repair, etc. Also shown are the cantilever winch decks 41 and the complete faired-in cantilevers 52. Presented also is a vehicle main deck ramp 74 and well deck ramp 77. The watertight doors 80 will be open during ramp cargo traffic and closed at sea.

FIG. 19 is a plan view taken in the direction shown by line 19-19 in FIG. 17A of a new well deck of the LPD LCAC TRANSPORTER. Shown are four to-scale LCACs 70, 71, 72, and 73 in tandem to indicate the robustness of available width, if a similar to LPD well interior were used, to support any auxiliary operations such as mooring, fueling, repair, etc. These LCACs are not dependent on the platform 1, unless they were brought aboard via pier/wharf, in which case the platform's med-moor ramp would have been used; otherwise, depending on stern gate arrangements the LCACs would be brought straight in thru the transom.

Figure 20:
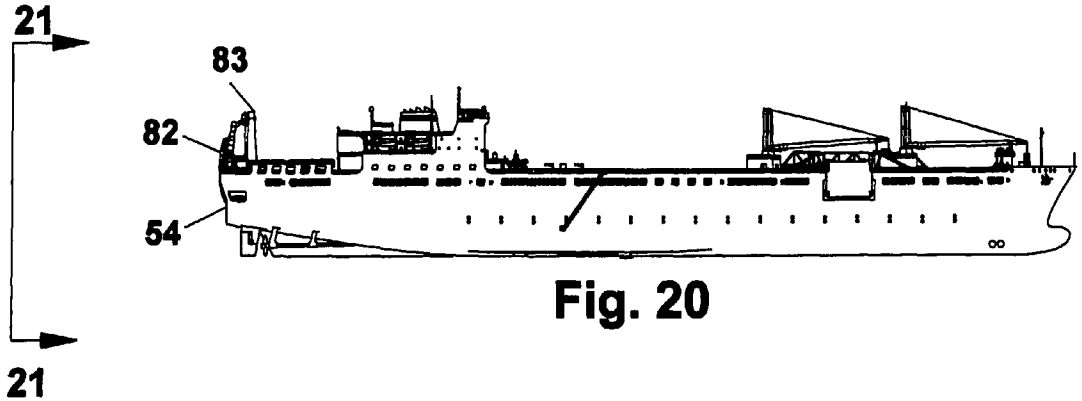
FIG. 20 displays the present outboard profile of the Bob Hope Class, T-AKR that serves as a baseline for a retrofit T-AKR AUTO-DISCHARGER with the $L^4$ system.

FIG. 20 displays the present outboard profile of the Bob Hope Class, T-AKR and serves as a baseline for a proposed retrofit T-AKR AUTO-DISCHARGER with the $L^4$ system. Shown of special note is the T-AKR's transom stern, which qualifies it as a suitable candidate for the $L^4$ system. However, the slewing ramp 82 and the supporting member sampson frame-post 83 being in the way, must be removed to permit the installation of the $L^4$ system. Additionally, the installation of weathertight doors of guillotine, flip-out, etc. type must be provided to prevent main deck flooding.

Figure 21:
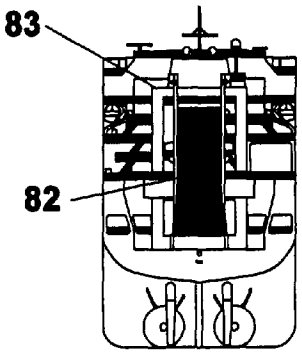
FIG. 21 gives the stem view (looking forward) in the direction shown by line 21-21 in FIG. 20. The as-built T-AKR is shown to have a stem ramp in the stowed position.

FIG. 21 gives the stem view looking forward in the direction of line 21-21 of FIG. 20 at double scale. The as-built T-AKR is shown to have a stem ramp 82 in the stowed position and a sampson frame-post 83.

Figure 22:
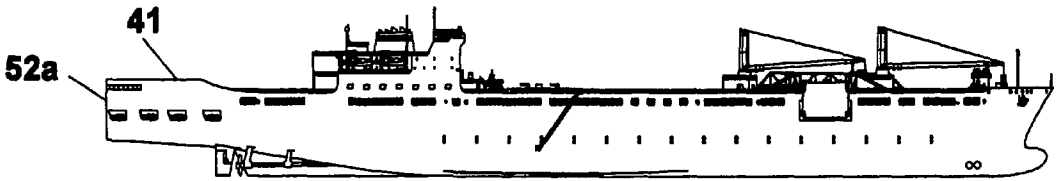
FIG. 22 shows the notional T-AKR AUTO-DISCHARGER as equipped with the $L^4$ system. It should be noted that the $L^4$ system's distinct ability of "fairing-in" is utilized to construct the cantilevers to the T-AKR. Also, it is shown that the $L^4$ system is clear of the ship's propellers and rudders.

FIG. 22 shows the notional T-AKR AUTO-DISCHARGER as the T-AKR but equipped with the $L^4$ system. It should be noted that the $L^4$ system's distinct ability of "fairing-in" is utilized to construct the cantilevers 52 to the T-AKR. Also, it is shown that the $L^4$ system is clear of the ship's propellers and rudders 60.

Figure 23:
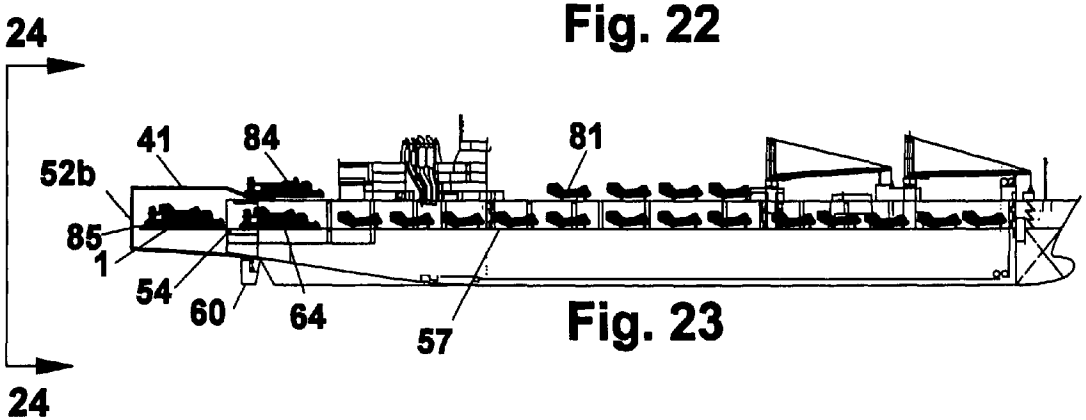
FIG. 23 is a greatly simplified inboard profile of the notional T-AKR AUTO-DISCHARGER showing an LCAC inside the vessel on the main deck, another LCAC on the upper-most deck, and a last LCAC on the platform positioned at the main deck. The notional T-AKR AUTO-DISCHARGER is shown to be able to carry three (3) LCACs with minimum modification as a refit.

FIG. 23 is a greatly simplified inboard profile of the notional T-AKR AUTO-DISCHARGER showing one LCAC 64 onboard the vessel on the main deck, one LCAC 84 on the upper-most deck, and one LCAC on the platform positioned at the main deck 57. The notional T-AKR AUTO-DISCHARGER is shown to be able to carry three (3) LCACs 64, 84 and 85 with minimum modification as a refit. The $L^4$ system allows for the loading of the LCACs with the ship's cargo, in this case the illustrated helicopters 81; and once loaded, it can be lowered for launching into the sea via platform 1. Furthermore, the notional T-AKR AUTO-DISCHARGER can recover and lift the LCACs from the sea and employ them for logistical operations.

Figure 24:
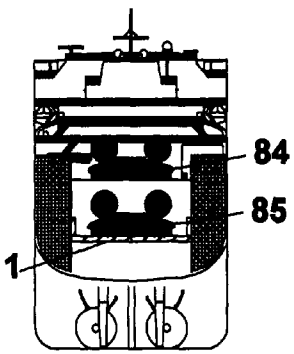
FIG. 24 is an aft view taken in the direction of line 24-24 of FIG. 23 showing the stem without its stem ramp. This is removal is necessary so that the platform could be fitted and operated with the LCACs having access to the hull and the upper-most deck. The depiction shows two representations of the LCAC. One is the LCAC on the platform in the lowered position, while the other is the elevated LCAC at the upper-most deck. The platform is designed to stop at all intermediate decks.

FIG. 24 is an aft view in the direction of line 24-24 of FIG. 23 at double scale and shows the stem after removal of its stem ramp 82 and frame-post 83. This removal is necessary so that the platform 1 could be fitted and operated giving LCAC access to the hull and the upper-most deck. The depiction shows two representations of the LCACs. One is the LCAC 85 on the platform 1 at the main deck, while the other LCAC 84 on the platform 1 is at the upper-most deck. The platform 1 is designed to stop at all intermediate decks.

Figure 25:
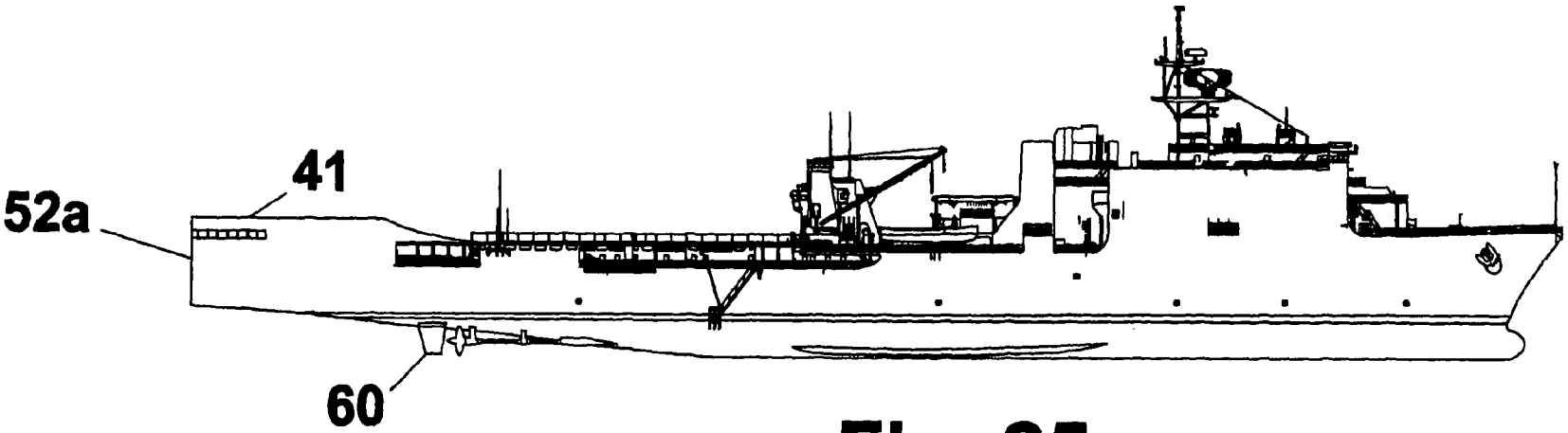
FIG. 25 presents an outboard profile of an LSD as equipped with the $L^4$ system.

FIG. 25 presents an outboard profile of an LSD LCAC ENHANCED vessel. This $L^4$ system application is identical to conception of the previous LPD LCAC ENHANCED. Shown in the drawing is the complete $L^4$ system typified by the cantilever 52, and the winch deck 41. It is demonstrated that the rudder 60 is well clear of the $L^4$ system appendage.

Figure 26:
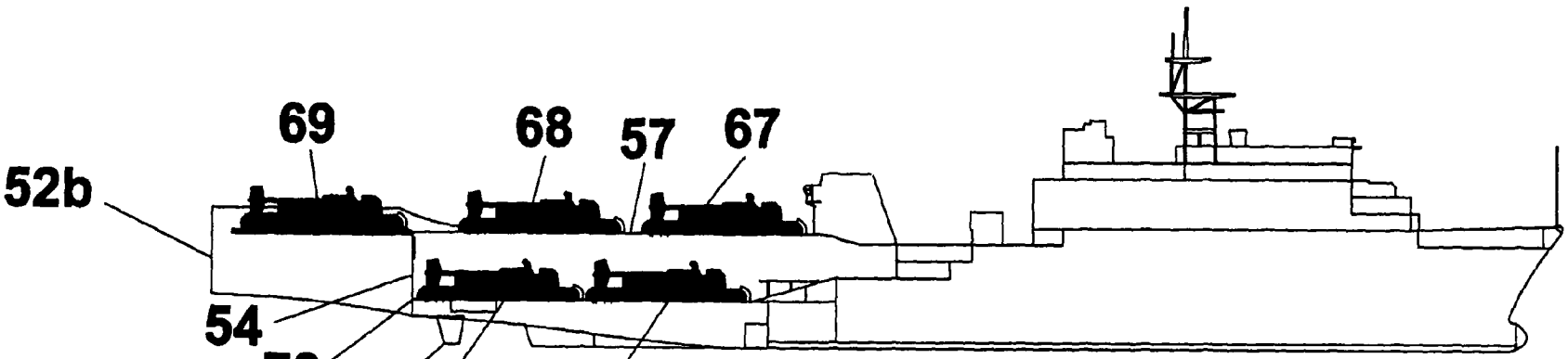
FIG. 26 shows an inboard profile of the same vessel depicted in FIG. 25. It can be seen that the vessel's original LCAC capacity of two (2), shown in the well deck, has been increased to five (5) (two LCACs on the upper-most deck and one on the platform) using the $L^4$ system. The refit modifications to the LSD would be nearly identical as to the LPD. Again, it is obvious that the LCAC operations would remain clear of propulsion and maneuvering devices.

FIG. 26 shows an inboard profile of the LSD LCAC ENHANCED. For the retrofit to be economical, the LSD's inherent transom stem 54 is valuable to the cantilever's fairing-in capability feature. The accomplishment with the appendage, it can be seen that the LSD's original LCAC 61 and 62 capacity shown in the well deck 78, has been increased to five (5) (two LCACs 67 and 68 on the upper-most deck and one 69 on the platform) using the $L^4$ system. The refit modifications to the LSD would be near identical as performed to the LPD in earlier figures. Again, it is obvious that the LCAC operations would remain clear of propulsion and maneuvering devices 60.

Figure 27:
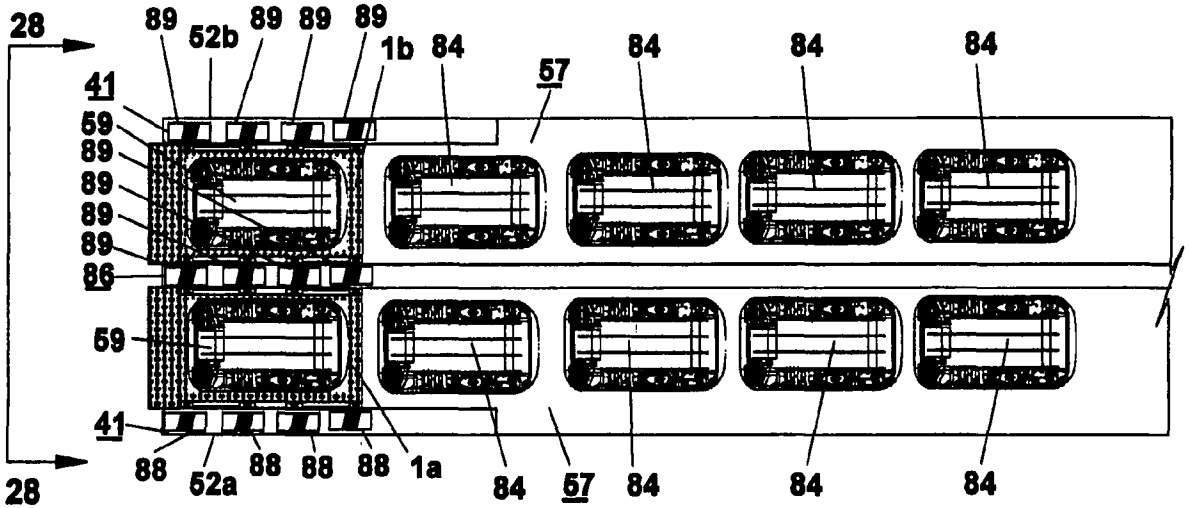
FIG. 27 presents a partial top view cargo deck and platforms of an intended "Super LCAC Transporter" ship prototype. Shown is the fundamental and unique feature of the $L^4$ system to self-adapt to develop a twenty-six (26) LCAC capacity for a post-Panamax vessel or for beams that are provided by the New Panamax (NPX) of the Panama Canal. This figure shows a total of ten (10) stowed LCACs: eight (8) LCACs on the main deck that were lifted by the platforms and two (2) LCACs stowed on the platforms. A vessel of this strategic importance is accomplished by the shown modified $L^4$ system, which is now comprised of two (2) independent platforms and three (3) cantilevers. Depending on the increased length of the vessel due to anticipated wider vessel beams, the LCAC capacity could be further increased by taking advantage of the longer decks beyond that which is shown.

FIG. 27 presents a top view of a prototype "Super LCAC Transporter's" cargo deck. The $L^4$ system is shown to be comprised two (2) independently operated platforms 1*a* and 1*b* and three (3) cantilevers: the starboard 52*a*, the port 52*b*, and the centerline 86. The cantilevers 52*a* and 52*b* support a single row of cable drums 88 and 89, whereas the centerline cantilever 86 supports two rows of cable drums 88 and 89. The starboard platform 1*a* is lifted by means of upper winch deck's 41 and lower winch deck's (FIG. 28, 87) cable drums 88, while the port platform 1*b* is lifted by means of the upper winch deck's 41 cable drums 89. This drum arrangement allows for independent lifting and stowage of eight (8) LCACs 84 on the main deck 57 with two (2) LCACs 59, one on each platform 1*a* and 1*b* as well as stowage and access to all intermediate decks.

Figure 28:
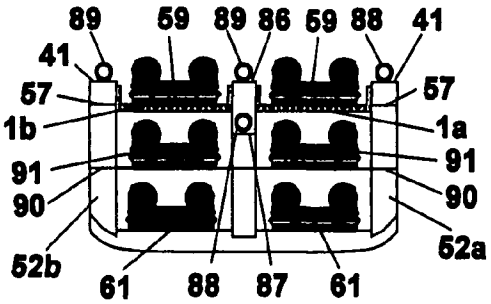
FIG. 28 shows an aft view looking forward in the direction of line 28-28 of FIG. 27 into the cargo structure of the prototype "Super LCAC Transporter". Noteworthy is that due to the $L^4$ system's attribute of "adaptability to design", the $L^4$ system is demonstrating its ability to service, in this case, three (3) decks of LCACs—a well deck, a second deck, and a main deck. Additional decks can be built as an increased vessel beam will permit for this potential.

FIG. 28 shows an aft view looking forward in the direction of line 28-28 of FIG. 27 into the cargo structure of the prototype "Super LCAC Transporter". The shown uppermost LCACs 59 are stowed on a starboard platform 1*a* and a port platform 1*b*, which are at located on the main deck 57. Besides servicing the main deck 57, these platforms also service the remaining sixteen (16) LCAC's of which eight (8) LCACs 91 are stowed on the second deck 90 and eight (8) LCACs 61 are stowed on well deck. The starboard platform 1*a* is lifted by means of the cable drums 88 located on the winch deck 41 of the starboard cantilever 52*a* and the lower winch deck 87 of the centerline cantilever 86. In like manner, the port platform 1*b* is lifted by means of the cable drums 89 located on the upper winch deck 41 of port cantilever 52*b* and upper winch deck of the centerline cantilever 86. The depicted $L^4$ system is a duplicate system of the previously described single system's benefits and attributes, but now is with a redundant hydraulic cross-over capability to operate the set of cable drums affected with hydraulic failure.

While the invention has been described in connection with a preferred and several alternative embodiments, it will be understood that there is no intention to thereby limit the invention. On the contrary, there is intended to be covered all alternatives, modifications, and equivalents as may be included within the spirit and scope of the invention as defined by the appended claims, which are the sole definition of the invention.

Glossary of Abbreviations and Acronyms

| | |
|---|---|
| AAAV | Advanced Amphibious Assault Vehicle |
| EFV | Expeditionary Fighting Vehicle |
| HSC | High Speed Connector |
| HSV | High Speed Vessel |
| ILP | Intermediate Landing Platform |
| LCAC | Landing Craft Air Cushion, (used as a generic craft described in the "Background of Invention") |
| LHA | Landing, Helicopter, Assault |
| LPD | Landing, Platform, Dock (U.S. Navy ship designation) |
| LSD | Landing Ship, Dock (aka Dock Landing Ship) |
| M1A1 | Main Battle Tank (U.S. Army designation) |
| MEDIVAC | Medical evacuation |
| MLP | Mobile Landing Platform |
| MPF (F) | Maritime Prepositioning Force (Future) |
| RRDF | Roll-on/Roll-off Discharge Facility |
| SES | Surface Effect Ship |
| T-AKR | Vehicle Cargo Ship (aka Sealift, U.S. DoD designation) |

What I claim is:

1. A system for increasing the capability of a naval ship having a transom stern, a waterline, decks above the waterline, a starboard side and a port side, said ship configured to store, discharge and load cargo, fuel, repair and provide a safe haven landing and launching facility for air cushion vehicles in open waters and at harbor, said system comprising:

at least two cantilever wing walls each having a forward end and an aft end, a right side and a left side, with the forward end of each wing wall attached to the transom stern of said ship and extending longitudinally aft from the transom stern;

a control station in one of said cantilever wing walls;

at least one elevator platform having a forward end, an aft end, a right side, and a left side, said elevator platform mounted between two adjacent ones of the cantilevered wing walls and vertically moveable with respect to said decks of the ship between a raised position and a lowered position for landing or launching the air cushion vehicles on or from the ship, said elevator platform further having a plated deck with through-deck ducts, said elevator platform further having positioning winches to secure the air cushion vehicles, the aft end of said elevator platform having a backstop fold-up gate and a medmoor ramp, said ducts each equipped with remotely-controlled valves to selectively permit or prevent passage of water and/or air therethrough, said valves controlled from a master console in said control station; and an elevator hoisting system on at least one of said cantilever wing walls for raising and lowering the elevator platform between said raised position and said lowered position to provide access to and from the waterline to the ship decks above the waterline.

2. The system of claim 1 where the elevator platform further comprises, a resistance reduction leading edge, locking pins and a transfer system for movement of air cushion vehicles.

3. The system of claim 2 where the transfer system for movement of air cushion vehicles further comprises vehicle movers.

4. The system of claim 2 where the transfer system for movement of air cushion vehicles further comprises hydraulic jack dollies.

5. The system of claim 2 where the transfer system for movement of air cushion vehicles further comprises motorized roller drum conveyors.

6. The system of claim 1 where the elevator hoisting system comprises a plurality of winches.

7. The system of claim 1 where the air cushion vehicles are Landing Craft Air Cushion vehicles.

8. The system of claim 7 where the elevator platform further comprises, a resistance reduction leading edge, locking pins and a transfer system for movement of air cushion vehicles.

9. The system of claim 7 where the transfer system for movement of air cushion vehicles further comprises vehicle movers.

10. The system of claim 7 where the transfer system for movement of air cushion vehicles further comprises hydraulic jack dollies.

11. The system of claim 7 where the transfer system for movement of air cushion vehicles further comprises motorized roller drum conveyors.

12. The system of claim 7 where the elevator hoisting system comprises a plurality of winches.

* * * * *